US005542510A

United States Patent [19]

Rekuc et al.

[11] Patent Number: 5,542,510

[45] **Date of Patent: * Aug. 6, 1996**

[54] ROLLING CATALOG CASE WITH PULL-OUT HANDLE

[75] Inventors: Richard J. Rekuc, Pattenburg; James O'Shea, Annadale, both of N.J.

[73] Assignee: Royalox International, Inc., Phillipsburg, N.J.

[ * ] Notice: The portion of the term of this patent subsequent to Oct. 8, 2013, has been disclaimed.

[21] Appl. No.: 434,734

[22] Filed: May 4, 1995

Related U.S. Application Data

[63] Continuation of Ser. No. 133,976, Oct. 8, 1993, Pat. No. 5,435,423.

[51] Int. Cl.[6] ..... A45C 5/14; A45C 13/28

[52] U.S. Cl. ..... 190/18 A; 190/39; 190/115; 280/37; 280/655; 280/47.315; 16/115

[58] Field of Search ..... 190/18 A, 39, 190/115; 280/37, 655, 655.1, 47.315; 16/115

[56] References Cited

U.S. PATENT DOCUMENTS

| | | | |
|---|---|---|---|
| 3,606,372 | 9/1971 | Browning | 190/108 X |
| 3,799,568 | 3/1974 | Hager | 280/37 |
| 4,183,520 | 3/1989 | Lin | 190/116 X |
| 4,256,320 | 3/1981 | Hager | 190/18 A X |
| 4,261,447 | 4/1981 | Arias et al. | 190/18 A |
| 4,358,005 | 11/1982 | Fontana | 190/115 X |
| 4,411,343 | 10/1983 | Cassimally et al. | 190/115 X |
| 4,759,431 | 7/1988 | King et al. | 190/18 A |
| 4,890,705 | 1/1990 | Pineda | 190/115 X |
| 4,979,598 | 12/1990 | Verheij et al. | 190/115 X |
| 4,995,487 | 2/1991 | Plath | 190/115 X |
| 5,048,649 | 9/1991 | Carpenter et al. | 190/18 A |
| 5,075,925 | 12/1991 | Maloney | 190/115 X |
| 5,108,119 | 4/1992 | Huang | 190/18 A X |
| 5,199,811 | 4/1993 | Huang | 280/655 X |
| 5,253,739 | 10/1993 | King | 190/18 A |
| 5,291,976 | 3/1984 | Ku | 190/117 X |
| 5,294,145 | 3/1994 | Cheng | 280/655 X |
| 5,313,817 | 5/1994 | Meinders | 190/18 A X |
| 5,367,743 | 11/1994 | Chang | 280/47.315 X |
| 5,368,143 | 11/1994 | Pond et al. | 190/115 X |
| 5,431,262 | 7/1995 | Rekuc et al. | 190/102 X |

FOREIGN PATENT DOCUMENTS

| | | | |
|---|---|---|---|
| 2632262 | 12/1989 | France | 190/18 A |
| 2353629 | 5/1974 | Germany | 190/18 A |
| 226769 | 9/1985 | Germany | 190/115 |
| 2158399 | 11/1985 | United Kingdom | 280/655 |
| 2168035 | 6/1986 | United Kingdom | 190/18 A |
| 9214638 | 9/1992 | WIPO | 280/655 |

*Primary Examiner*—Sue A. Weaver
*Attorney, Agent, or Firm*—Herbert Dubno

[57] ABSTRACT

A catalog case has a molded body attached to its bottom or hinge thereto and forming channels for the shanks of a pull-out handle which can be used to pull the case along. Preferably the case has two wheels at the rear end opposite the handle so that the case can be tilted upwardly about these wheels and pulled along the ground or floor while the wheel rides thereon. The pull-out handle can engage in grips at both ends of its travel so that the handle is only fixed relative to its guides at the opposite ends of its travel.

4 Claims, 11 Drawing Sheets

FIG. 9
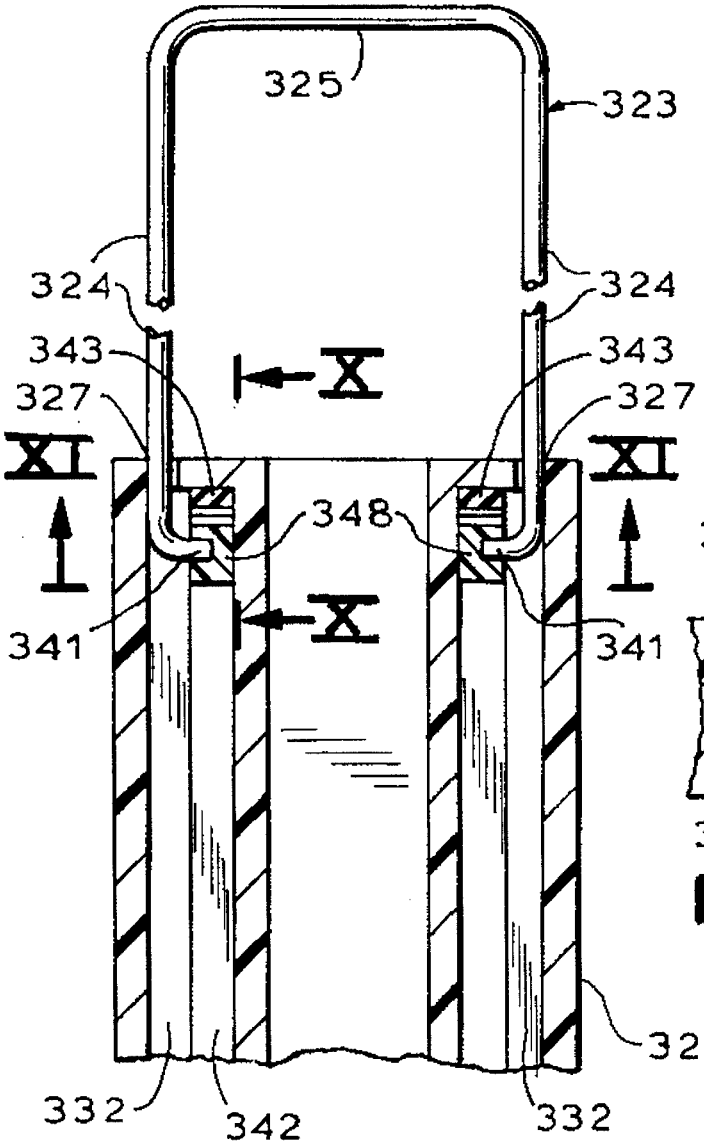
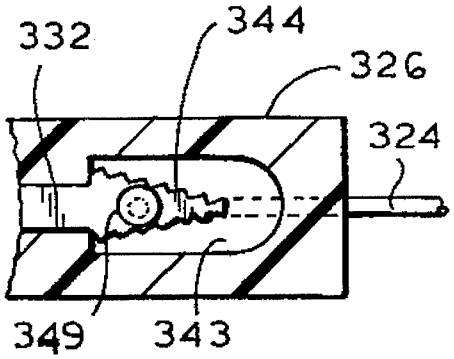
FIG. 10
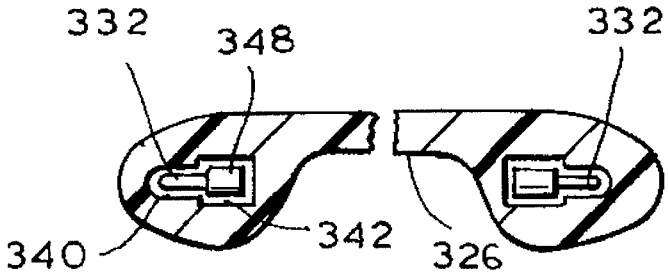
FIG. 11

FIG. 12
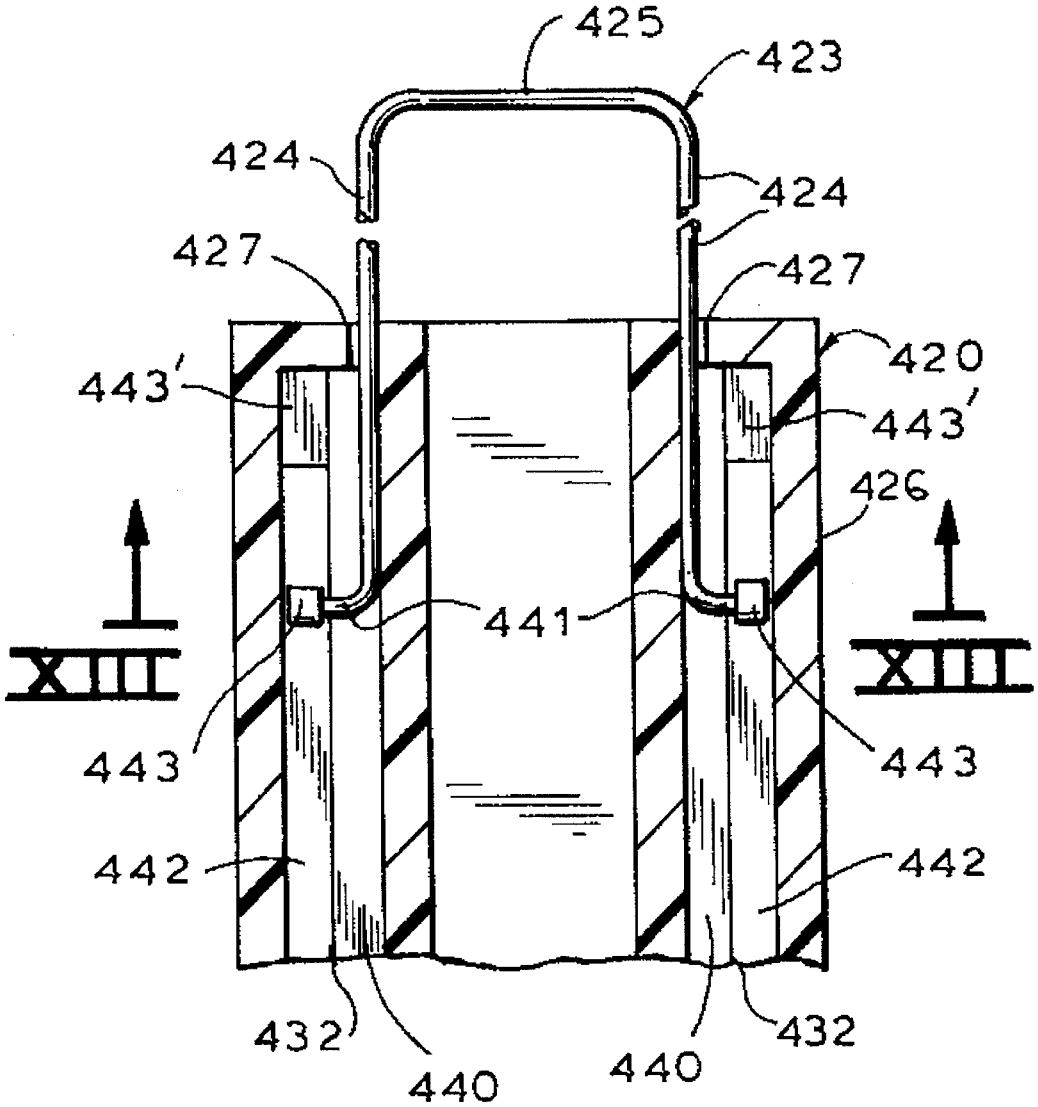
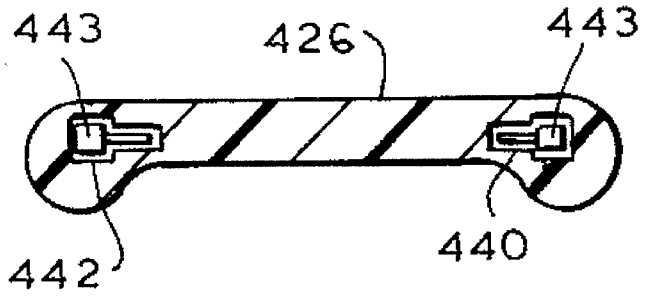
FIG. 13

ROLLING CATALOG CASE WITH PULL-OUT HANDLE

This is a continuation of application Ser. No. 08/133,976 filed on 8 Oct. 1993, U.S. Pat. No. 5,435,423.

FIELD OF THE INVENTION

The present invention relates to luggage and, more particularly, to a luggage article having a pull-out handle and capable of rolling along a support surface. In particular, this invention relates to an article of luggage of the type frequently referred to as a catalog case. The invention also relates to an improved pullout handle assembly for luggage articles of this type and for other types of articles, including articles in which the guides are disposed internally of the article.

BACKGROUND OF THE INVENTION

In recent years the use of separate wheeled luggage carriers which are collapsible and having a telescoping handle assembly has been paralleled by a growth in the use of wheeled luggage in which, generally, four wheels were provided on the bottom of a rectangular parallelepipedal luggage article which could have a tether or handle at the top adapted to be pulled by the user to tow the article along the ground or floor.

More recently it has been found to be advantageous to provide the handle so that it can pull out form the luggage article directly.

Such systems have not been fully successful heretofore. For example, the pull-out handle assembly may not be fully reliable or may be subject to wear because of continuous friction between the handle and its guides.

Not all luggage articles can adequately be provided with prior art handle structures and, for example, catalog cases cannot adequately be formed with conventional pull-out handle structures.

OBJECTS OF THE INVENTION

It is, therefore, the principal object of the present invention to provide an improved pull-out handle assembly for luggage articles which improves upon conventional designs and is free from a number of drawbacks of such earlier systems.

Still another object of the invention is to provide an improved pull-out handle assembly which is essentially adapted for use with catalog cases and other luggage articles in which the assembly must be external to the case.

A further object of our invention is to provide an improved article of luggage which can have only two wheels adapted to ride on the ground or floor and which can be provided with a pull-out handle assembly in an improved manner.

Still another object is the provision of an improved catalog case.

SUMMARY OF THE INVENTION

These objects and others which will be apparent hereinafter can be attained with a pull-out assembly for luggage comprising:

a pair of mutually parallel channels open at least at one end and transversely spaced apart, the channels being affixed to an article of luggage along opposite edges thereof;

a stirrup-shaped handle having respective shanks receivable in the channels and a crossbar connecting the shanks externally of the channels, the shanks each having a free end guided in a respective one of the channels and provided with a formation projecting transverse to the respective shank the channels each having a passage receiving the respective shank and a slot laterally open toward the respective passage and guiding the respective formation to restrict twisting of the respective shank on the respective passage and canting of the crossbar upon retraction and extension of the handle relative to the channels; and releasable locking means at opposite ends of the channels engageable with the formations to lock the handle releasably in a fully retracted and in a fully extended position.

Advantageously, the channels are formed in a common molded body affixed on an exterior of the article and which can be separate from a molded body carrying the wheels and hinged thereto, if desired, and can be the molded body carrying the wheels.

Where the article is a case, especially a catalog case, having a top, a bottom, two side walls and two end walls, the molded body can be affixed along the bottom and can have only one pair of wheels journaled thereon at an end of the bottom adjacent one of the end walls. The body can be formed with a foot at an end thereof remote from the wheels for supporting the case when the case rests on a surface such as the floor or the ground.

Alternatively the molded body from which the handle can be partially extracted can be hinged to the case so as to lie along one of the end walls in a carrying position of the case and to swing away from that end wall for pulling of the case by the handle. In this construction, the case can have only one pair of wheels as has been described or two pairs of wheels along the bottom.

When the molded body is hinged to the case, a strut can be articulated to the molded body and can be guided on the aforementioned end wall of the case to limit the excursion of the molded body about its hinge.

According to another feature of the invention, the formations provided on the shanks of the handle are inwardly turned bent ends and these ends can be provided with respective sleeves of a plastic material which can engage, only at the ends of the travel of the handle, in toothed wedge-like grippers. The sleeves and shanks generally are so guided as frictionlessly or with a minimum of friction to travel between the limiting portions in which the handle can be locked for carrying of the case or pulling thereof respectively.

The ends can be bent inwardly or outwardly and the wedge-like grippers can be intrinsically elastic or provided with a spring for ensuring engagement of the bent end of the shank. The sleeves can either be engaged in the grippers or guided simply in the larger groove while the grippers can be provided in the narrow groove to engage the bent end along side of the sleeve.

It will be apparent, moreover, that the invention also comprehends an article of luggage, especially a catalog case, which comprises:

a carrying case having a top, a bottom, two sides and two end walls;

a pull-out handle assembly affixed to the case and formed with a pair of mutually parallel channels open at least at one end and transversely spaced apart, a stirrup-shaped handle having respective shanks receivable in the channels and a crossbar connecting the shanks externally of the channels, the shanks each having a free end guided in a respective one of the channels and provided with releasable locking means at opposite ends of the channels engageable with the shanks to lock the handle releasably in a fully retracted and in a fully extended position; and a pair of wheels affixed to the bottom of the case adjacent an end wall thereof, whereby upon extension of the handle the case can be tilted to rest upon the wheels and drawn along a support surface by the handle.

BRIEF DESCRIPTION OF THE DRAWING

The above and other objects, features, and advantages will become more readily apparent from the following description, reference being made to the accompanying drawing in which:

FIG. 9 is a diagrammatic section through a handle assembly which can be used for the carrying cases of FIGS. 1–8;

FIG. 10 is a section taken along the line X—X of FIG. 9;

FIG. 11 is a section taken along the line XI—XI of FIG. 9;

FIG. 12 is a section similar to FIG. 9 illustrating another embodiment;

FIG. 13 is a section taken along the line XIII—XIII;

SPECIFIC DESCRIPTION

Figure 1:
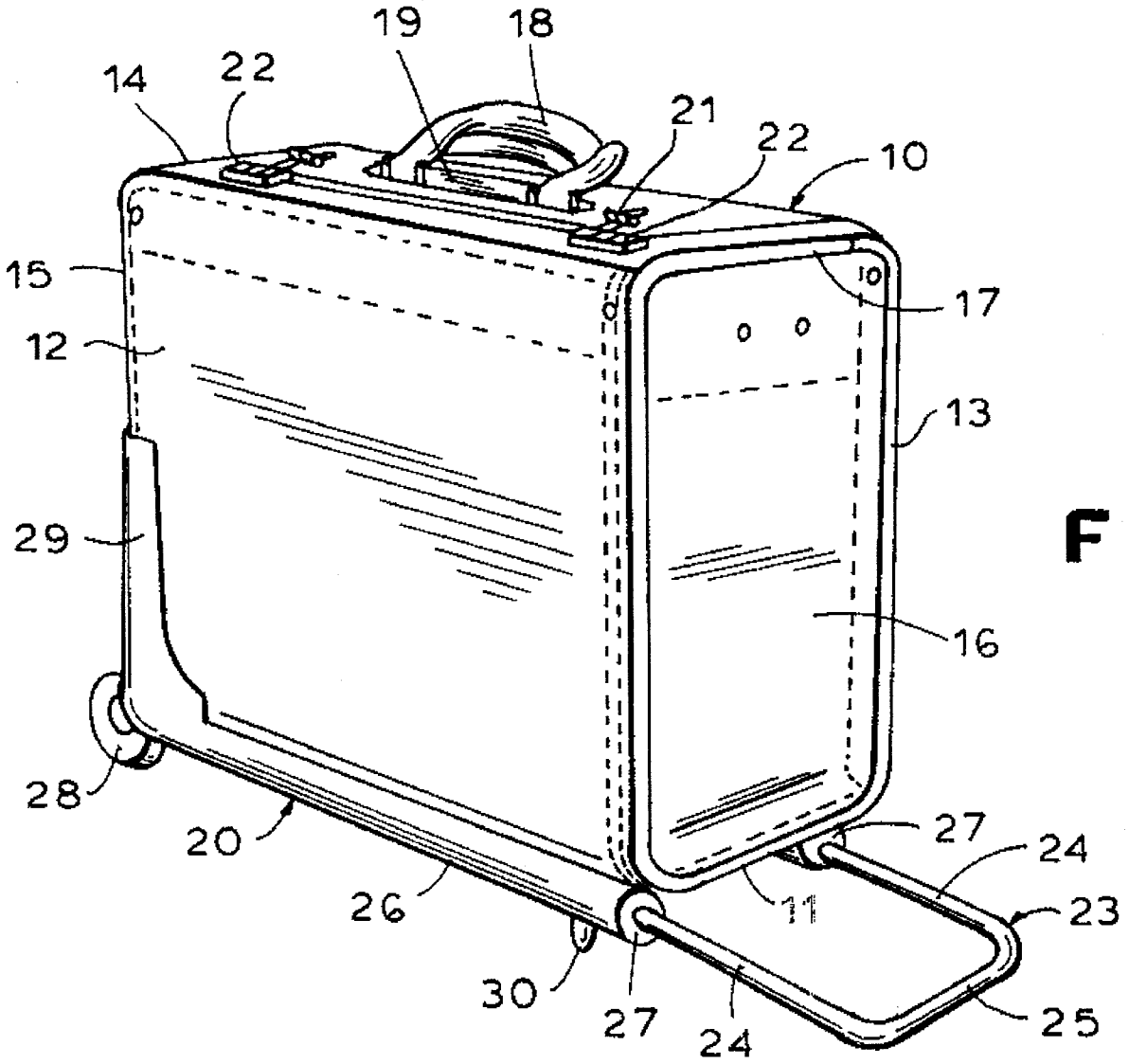
FIG. 1 is a perspective view of a catalog case of the two-wheeled type, according to the invention, showing the handle partly extended therefrom.
Figure 2:
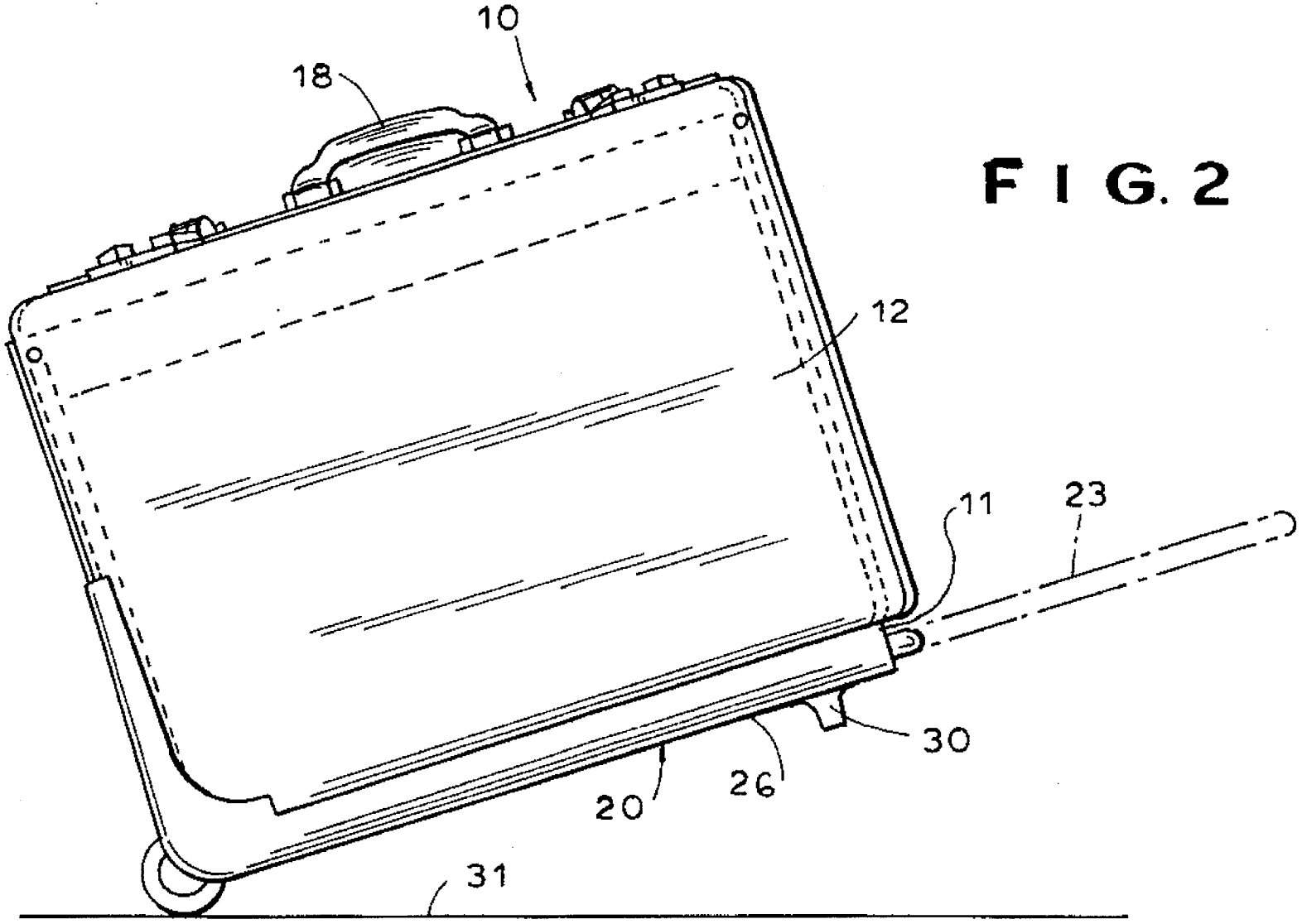
FIG. 2 is a side elevational view of this catalog case with the handle in a fully retracted position but showing its extended position in dot-dash lines.

As can be seen from FIGS. 1 and 2, a conventional catalog case 10 which has a bottom 11, two side walls 12 and 13, a top 14 and end walls 15 and 16 can be provided with a pull-out handle assembly generally represented at 20 and which will be described in greater detail with respect to FIGS. 9–11.

In this type of case, the side wall 12 has a flap 17 which is turned inwardly and carries a hinged carrying handle 18 passing through a slot 19 in a flap 21 of the side wall 13, the two flaps being held in the closed position by catches 22.

The pull-out assembly 20 comprises a handle 23 having shanks 24 connected by a cross bar 25 at one end and received in guide channels within a molded body 26. The guide channels open at 27 at one end of the molded body 26.

In this embodiment the molded body carries only a single pair of wheels represented by the wheel 28 which is journaled on the molded body at the bottom of the case adjacent the end wall 15.

The molded body 26 can also be formed with an upstanding portion 29 protecting the end wall 15 and the edges thereof adjacent the wheel against impact with objects such as steps or curbs. In addition, in this embodiment, feet 30 can be provided on the molded body to support the case level on the ground. For carrying purposes the handle 23 is fully retracted and the handle 18 can be gripped. For pulling of the article along the ground, the handle can be extended as shown in dot-dash lines in FIG. 2 and the case tilted to ride along the surface 31 when the handle is pulled by the user. The molded body can be affixed by rivets or the like conventional in the art to the bottom of the case and to the end wall 15 thereof.

Figure 3:
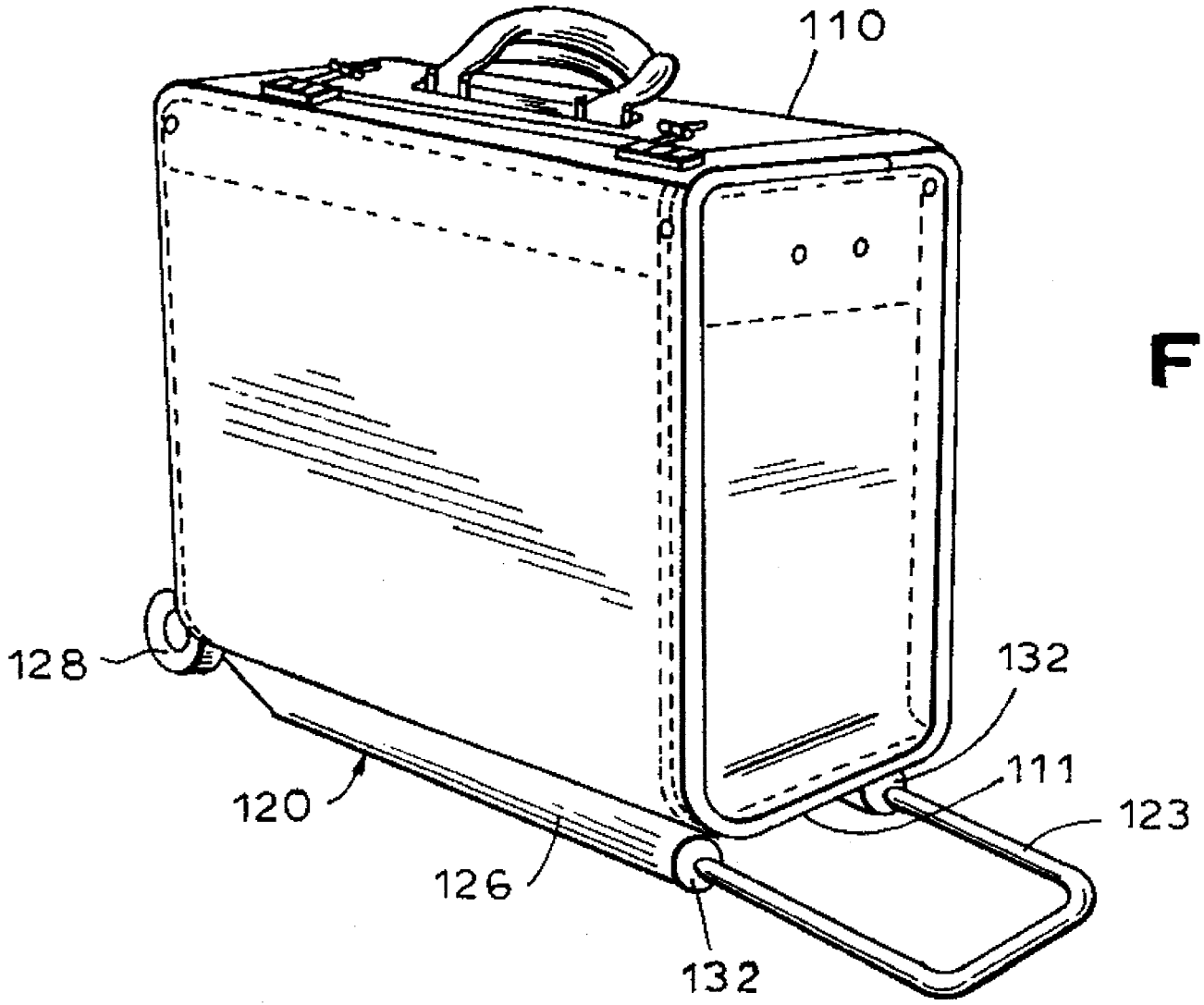
FIG. 3 is a perspective view of an embodiment of the catalog case which is somewhat different form the embodiment of FIGS. 1 and 2.
Figure 4:
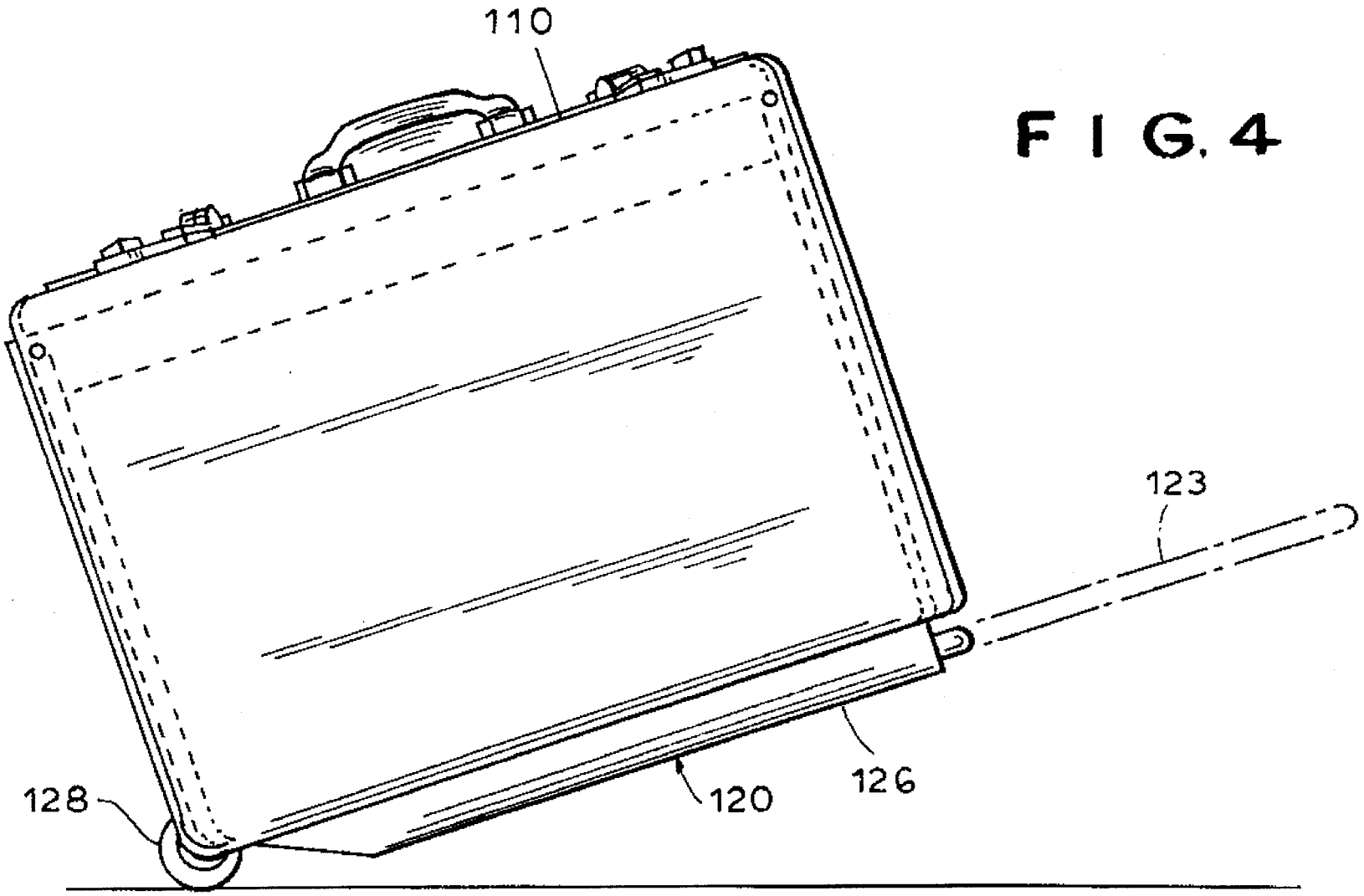
FIG. 4 is a view similar to FIG. 2 of this second embodiment.

In the embodiment of FIGS. 3 and 4, the case 110 has along its bottom 111, a handle assembly 120 whose molded body 126 is provided with the wheels 128 and the handle 123. In this case, the channels 132 project sufficiently below the wheels 128 that the case 110 can be supported level on the surface, without molded feet 30. The two positions analogous to the positions of FIGS. 1 and 2 are represented in FIGS. 3 and 4 for this second embodiment of the case.

A third embodiment of the catalog case is represented in FIGS. 5–8. In this embodiment the case 210 has a pull-out handle assembly 220 formed with a molded body 226 from the channels 232 of which, the handle 223 can be drawn and into which the handle can be pushed when the case 210 is to be carried by its handle 218.

In this embodiment, the wheels 228 are provided upon a separate molded structure 233 extending along the bottom and provided at 229 with a rear protector as has been described for the protector 29 previously.

The molded body 233 has another pair of front wheels 234 journaled thereon.

The molded body 226 is hinged at 235 to the front lower edge of the case, preferably to the molded body 233 and can be swung inwardly about this hinge to overlie the end wall 216 of the case. A strut 236 is guided in rails 237 of the end wall 216 and can pivot relative to the end wall. In addition, the strut 236 is articulated at 238 to the molded body 226. The strut 236 can have a releasable lock at the lower end of the guides or rails 237.

Figure 5:
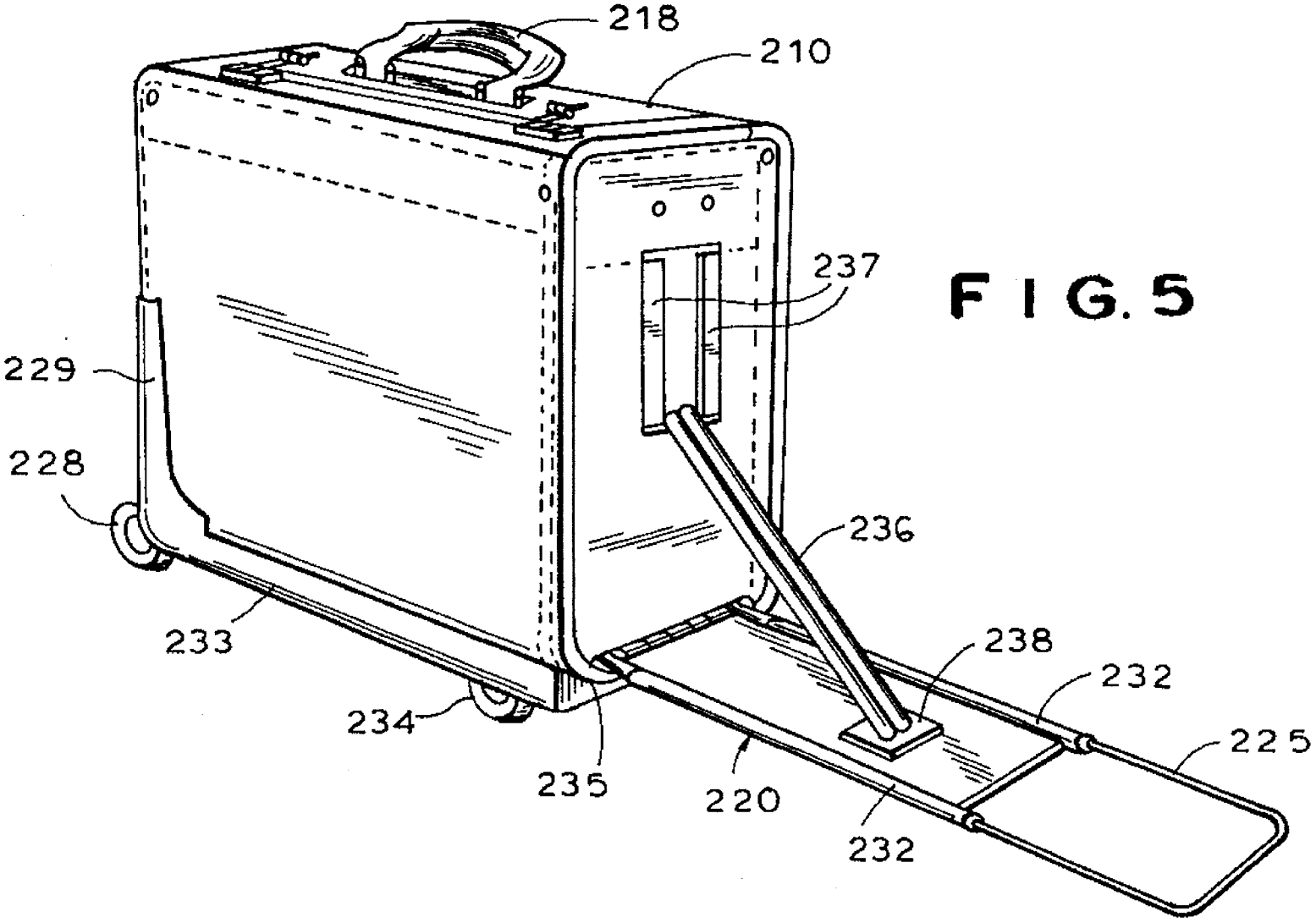
FIG. 5 is perspective view of a third embodiment of a catalog case according to the invention.
Figure 6:
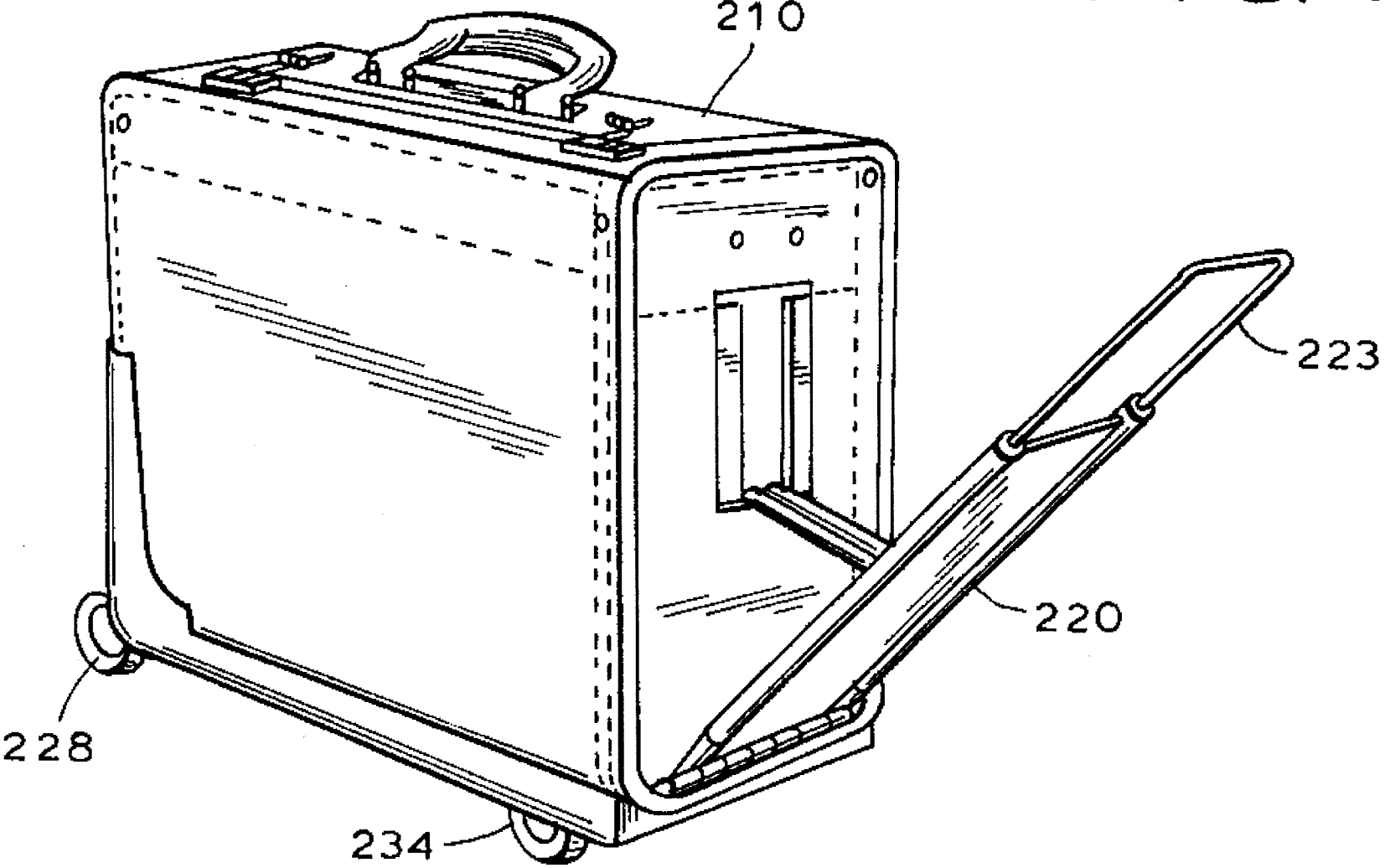
FIG. 6 is a perspective view of the third embodiment showing the handle assembly partly swung away from its end wall in a pulling position different from the position shown in FIG.
Figure 7:
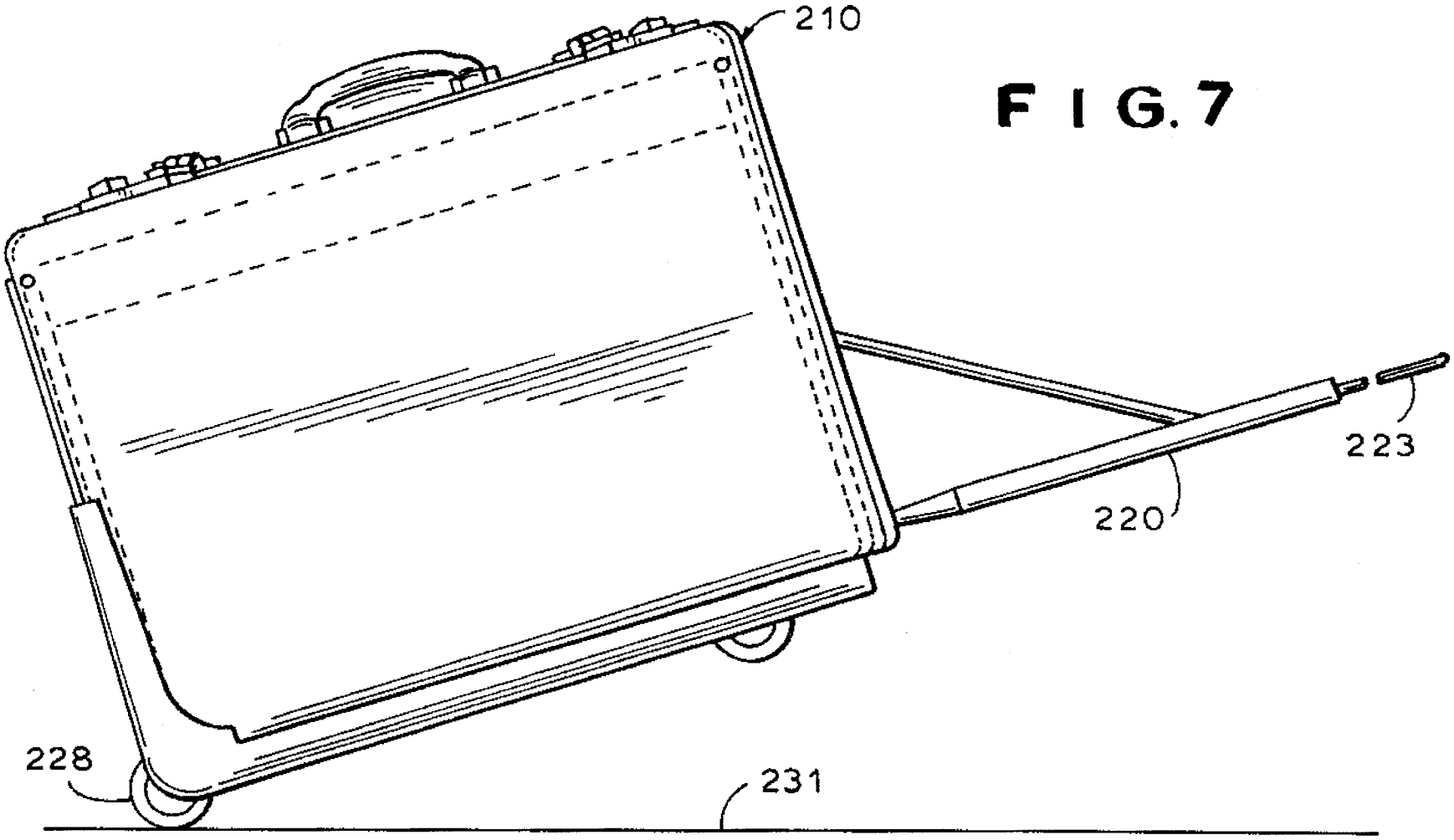
FIG. 7 is a side elevational view of the carrying case with the handle assembly fully swung out as in FIG. 5 showing the pulling of this case.
Figure 8:
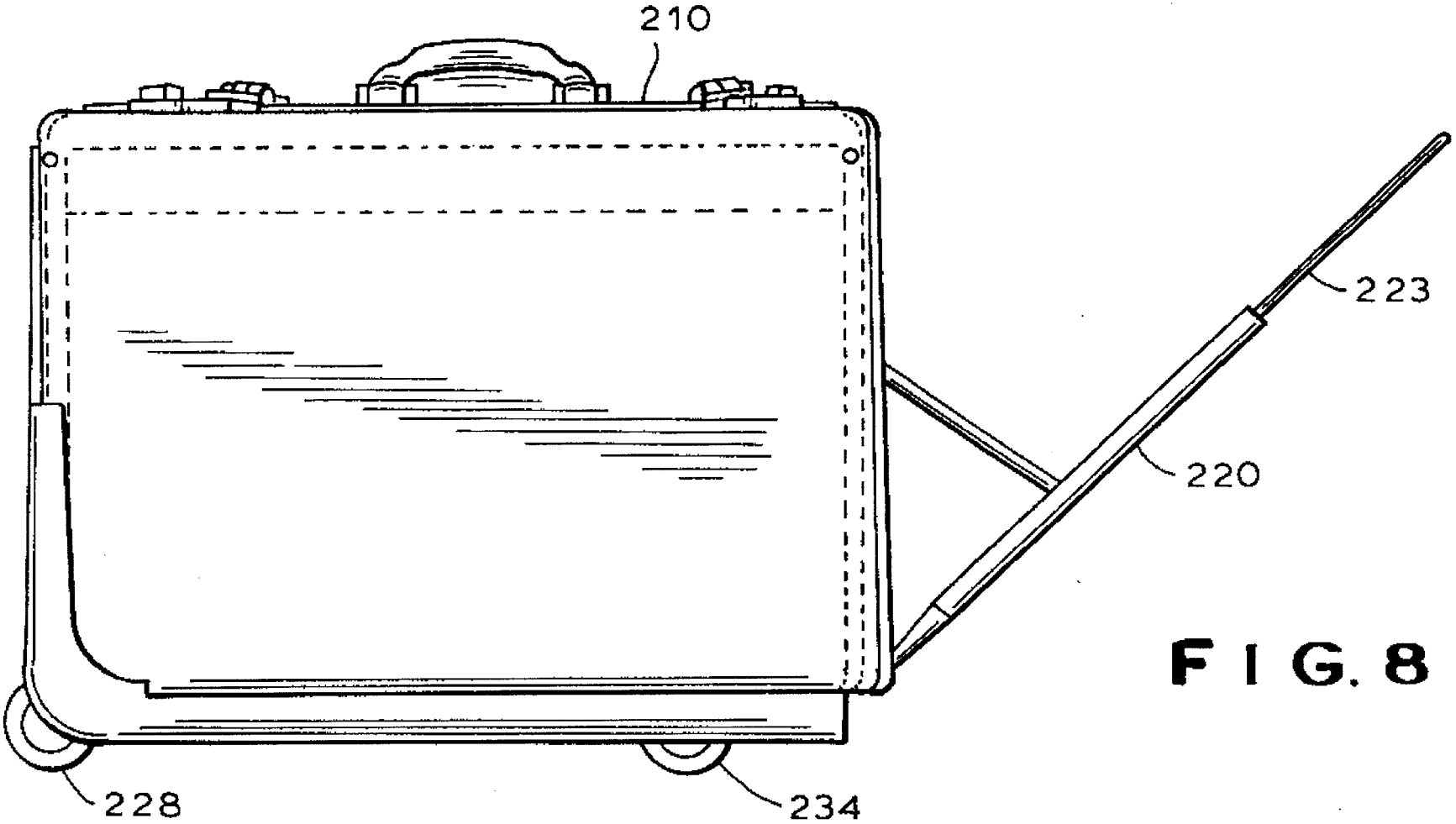
FIG. 8 is a side elevational view of the case in its position equivalent to FIG. 6.

Consequently, when the assembly 220 is swung fully open FIGS. 5 and 7), the handle 223 can be extended and the case tilted so that it can be drawn along the surface 231 by the user only via its rear wheels 228.

When, however, the assembly is only partly swung out, both sets of wheels 228 and 234 continue to rest upon the ground (FIGS. 6 and 8) and the case can be drawn therealong with a handle 223 in the orientation shown in these figures.

As can be seen from FIGS. 9–11, the handle assembly in all cases may have the construction shown from the handle assembly 320 with its handle 323 and molded body 326 corresponding to the molded bodies 26, 126, 226 previously described. The handle 323 here has the cross bar 325 and a pair of shanks 324 passing through openings 327 into the guide channels 332.

More specifically, the guide channels 332 have narrow tracks 340 adapted to accommodate the shanks 324 and their inwardly bent formations 341, as well as wider tracks 342 adapted to accommodate CELCON sleeves or caps 343 provided on the bent ends 341.

At the ends of the channels, CELCON caps can be engaged in V-shaped gripping devices 348 having two jaws 344 and composed of a softer molded rubber type material like VANDAR.

Since the CELCON plastic is self-lubricating, the shank of the handle are guided in the channel with no resistance with the grips at the ends of the path.

The CELCON caps are confined to the larger tracks of the channel and cannot enter the smaller tracks, thereby preventing the handle from canting and the shanks from twisting. The CELCON caps are released from the respective grippers by pulling or pushing the handle with sufficient force.

In FIGS. 12 and 13 we have shown an embodiment in which the handle assembly 420 has a handle 423 and a molded body 426 corresponding to the molded bodies 26, 126 and 226 previously described. The handle 423 has a cross bar 425 and a pair of shanks 424 passing through openings 427 into the guide channels 432.

The guide channels have narrow tracks 440 adapted to accommodate the shanks 424 and located inwardly of the wider tracks 442 so that the outwardly bent formations 441 on the shanks can have CELCON sleeves or caps 443 in the wider track. Here, as in FIGS. 9–11, at the ends of the channels, V-shaped gripping devices 443' which are intrinsically elastic are provided by analogy to the grippers 343 previously described. Here, as in the previous embodiments the CELCON caps are confined to the larger tracks of the channel and cannot enter the smaller tracks, thereby preventing the handle from canting and the shafts from twisting.

The grippers can also engage the bent portions 441 inwardly of the caps 443 as has been illustrated in connection with FIG. 16 to be further described below.

Figures 14, 15, 16:
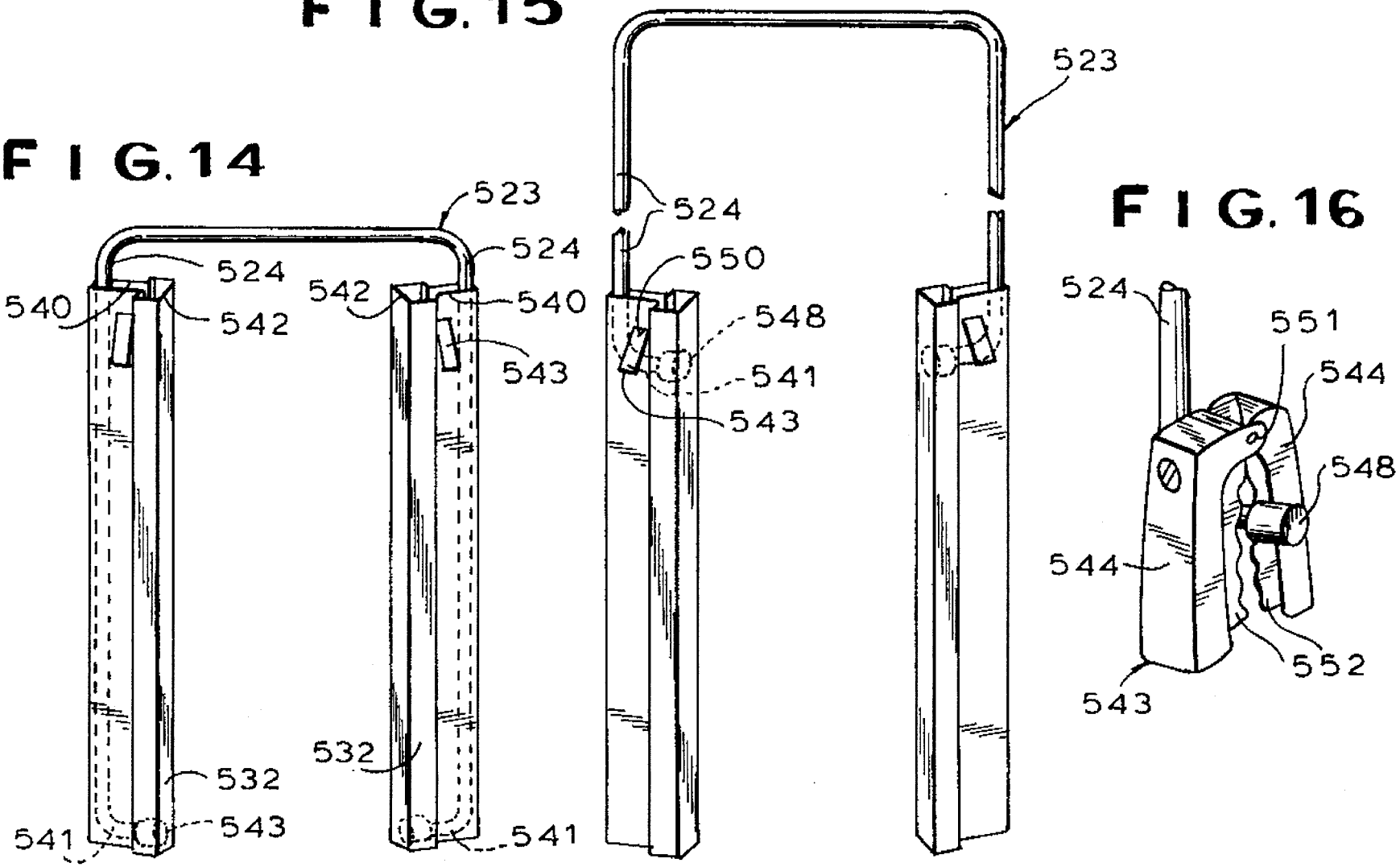
FIG. 14 is a diagrammatic perspective view illustrating another feature of the invention relating to the handle.
FIG. 15 is a view similar to FIG. 14 but showing the handle in another position.
FIG. 16 shows a spring loaded gripper which can be used in the other embodiments but is specifically shown in position in FIGS. 14 and 15.

While a molded construction is shown in FIGS. 9–13 to be provided unitarily with the tracks, the tracks can be embedded separately in a molded body are affixed to molded bodies in any conventional manner, but can be formed by metal extrusions as shown at 532 in FIGS. 14 and 15. Here the metal extrusions provide the narrow tracks 540 and the wider tracks 542 while the bends of the shanks 524 of the handle 523 are turned inwardly and carry the caps 448 previously described. In this embodiment, however, the V-shaped grippers 543 are received in openings 550 of the extrusions and engage the bends 541 inwardly of the caps 548 as is clearly visible in FIG. 16. As can be seen here the two arms 544 of each gripper 543 are connected by a hinge 551 and are traversed inwardly by a torsion spring not shown so as to spring load the gripper inwardly. The arms 544 of the gripper may be lined with a border material and in soft rubber and one which is more wear resistant, the lining 552 being toothed.

Apart from a difference in structure, the grippers hare operate as has previously been described.

We claim:

1. An article of luggage comprising:

a case having a bottom, a top and walls connecting the bottom with the top;

at least one pair of wheels mounted on said case at said bottom; and a handle assembly affixed to said bottom of said case and comprising:

guide means forming a pair of transversely spaced mutually parallel molded channels affixed along said bottom of said case and open at one end, said guide means forming feet on said case and on which said case can rest on the ground, a stirrup-shaped handle having respective shanks of lengths corresponding substantially to lengths of said channels and received in said channels, and a cross-bar connecting said shanks externally of said channels, said shanks emerging from said channels at said one ends thereof and having free ends in said channels, said free ends being provided with respective formations, said channels being provided with means for guiding said shanks between retracted positions of the shanks wherein said shanks are substantially fully received in said channels and said free ends of said shanks are located at locations distal from said one ends of said channels and extended positions of the shanks wherein said free ends of said shanks are located at locations close to said one ends of said channels, and retaining means formed with respective deformable portions in walls of said channels at said locations and releasably receiving said formations on said free ends of said shanks to lock said handle releasably in a fully retracted and in a fully extended position only at said locations.

2. The article defined in claim 1 wherein each of said free ends is formed with a respective sleeve of a plastic material constituting a respective one of said formations.

3. A pull-out handle assembly for luggage comprising:

at least one molded body formed with a pair of transversely spaced mutually parallel channels adapted to be affixed to an article of luggage and open at one end, a stirrup-shaped handle having respective shanks of lengths corresponding substantially to lengths of said channels and received in said channels, and a crossbar connecting said shanks externally of said channels, said shanks emerging from said channels at said one ends thereof and having free ends in said channels, said free ends being provided with respective formations, said channels being provided with means for guiding said shanks between retracted positions of the shanks wherein said shanks are substantially fully received in said channels and said free ends of said shanks are located at locations distal from said one ends of said channels and extended positions of the shanks wherein said free ends of said shanks are located at locations close to said one ends of said channels, and retaining means formed with respective deformable portions in walls of said channels at said locations and releasably receiving said formations on said free ends of said shanks to lock said handle releasably in a fully retracted and in a fully extended position only at said locations.

4. The assembly defined in claim 3 wherein each of said free ends is formed with a respective sleeve of a plastic material constituting a respective one of said formations.

* * * * *